US006029862A

United States Patent [19]

Jones

[11] Patent Number: 6,029,862

[45] Date of Patent: Feb. 29, 2000

[54] SELECTABLE RATE ACTUATOR FOR SPRAY CANS

[76] Inventor: Myra L. Jones, 554 4th Ave., Jonesborough, Tenn. 37659

[21] Appl. No.: 09/198,006

[22] Filed: Nov. 23, 1998

[51] Int. Cl.[7] ..... B65D 83/00

[52] U.S. Cl. ..... 222/402.11; 222/402.13; 222/402.14; 222/402.15; 222/470

[58] Field of Search ..... 222/402.11, 402.13, 222/402.14, 402.15, 470, 473, 474

[56] References Cited

U.S. PATENT DOCUMENTS

| | | | |
|---|---|---|---|
| D. 333,095 | 2/1993 | Haubner . | |
| D. 355,824 | 2/1995 | Smrt . | |
| 2,830,742 | 4/1958 | Gibbons et al. | 222/473 X |
| 2,960,260 | 11/1960 | Kutik | 222/402.15 X |
| 3,659,791 | 5/1972 | Clark | 222/474 X |
| 3,734,357 | 5/1973 | Batistelli et al. | 222/474 X |
| 3,856,209 | 12/1974 | Hickson . | |
| 4,089,440 | 5/1978 | Lee . | |
| 4,098,436 | 7/1978 | Kohlbeck | 222/474 X |
| 4,401,240 | 8/1983 | Brack | 222/474 X |
| 4,456,153 | 6/1984 | Meshberg | 222/402.13 X |
| 4,579,258 | 4/1986 | Brown et al. . | |
| 4,660,745 | 4/1987 | Hess, Jr. . | |
| 4,805,812 | 2/1989 | Brody . | |
| 4,886,191 | 12/1989 | Yoshitomi . | |
| 5,307,959 | 5/1994 | Bedore et al. . | |
| 5,318,208 | 6/1994 | Van Der Wal | 222/402.13 |
| 5,518,148 | 5/1996 | Smrt . | |

*Primary Examiner*—Kenneth Bomberg

[57] ABSTRACT

An actuation device for coupling with an aerosol spray canister and dispensing the pressurized contents contained in the canister includes a housing with a trigger assembly that is spring biased to operate between depressed and released positions. The device further includes an engagement member pivotally mounted to a shaft within the housing. When the device is coupled with a canister, one end of the engagement member bears against a spray nozzle of the canister while an opposed end bears against the trigger assembly. The trigger assembly includes a spring biased pivotal flange configured such that a partial depression of the assembly followed by a release thereof causes the engagement member to automatically engage the spray nozzle to dispense a predetermined amount of spray. A full depression of the trigger assembly, however, causes a continuous dispensing of spray. The device further includes a locking assembly having flanges that can selectably prevent operation of the trigger assembly or hold the trigger assembly in a position for continuous dispensing of spray.

13 Claims, 9 Drawing Sheets

SELECTABLE RATE ACTUATOR FOR SPRAY CANS

BACKGROUND OF THE INVENTION

This invention relates generally to a device for holding and actuating an aerosol spray canister and, more particularly, to an actuation device which can selectably dispense a predetermined quantity of spray or a continuous stream of spray.

Various devices have been proposed for holding a spray can and for actuating the spray nozzle thereof to dispense its pressurized contents. Although assumably effective to prevent fatigue of a user's finger during continuous spraying or to facilitate spraying of hard to reach surfaces, such devices do not provide accurate control of the amount of spray dispensed from the canister.

It is common for a painter utilizing a spray can of paint to cover the desired surface by using repetitive short bursts of paint. Thus, the painter must attempt to repetitively apply the same amount and duration of pressure to the spray nozzle. The result of this approach results not only in a fatigued finger, but also in an inconsistent application of paint to the surface.

It is therefore desirable to have an actuation device which can automatically dispense the same quantity of spray from an aerosol canister each time a trigger is depressed and released. It is further desirable to have an actuation device which can selectably dispense the short burst of spray or a continuous stream of spray. Further, it is desirable that operation of an actuation device can be selectably maintained in a continuous spray mode or prevented altogether.

SUMMARY OF THE INVENTION

An actuation device constructed in accordance with the present invention includes a housing with a spring biased trigger assembly. An engagement member is pivotally coupled to a shaft within the housing with opposing ends of the member bearing against the nozzle of a spray canister and trigger assembly, respectively. The trigger assembly includes a pivotal flange such that a partial depression of the assembly followed by a release thereof causes the engagement member to automatically engage the spray nozzle to dispense a predetermined amount of spray. The trigger assembly further includes an upstanding flange adapted to cause a continuous dispensing of spray upon a full depression of the trigger assembly by a user.

The actuation device includes a locking assembly having slidable flanges that can selectably prevent operation of the trigger assembly or hold the trigger assembly in a continuous spray configuration. A conical shroud having a groove about its annular rim snappably holds a spray canister to the housing.

It is therefore an object of the invention to provide an actuation device which can dispense a predetermined quantity of spray from an aerosol spray canister.

Another object of the invention is to provide an actuation device, as aforesaid, which can dispense a continuous stream of spray from an aerosol spray canister.

Still another object of the invention is to provide an actuation device, as aforesaid, which can snappably hold an aerosol spray canister to the device.

A further object of the invention is to provide an actuation device, as aforesaid, having a trigger assembly which can be selectably actuated to provide either the predetermined or continuous quantities of spray.

A still further object of the invention is to provide an actuation device, as aforesaid, which can selectably maintain the trigger assembly in a continuous spray position or prevent operation of the trigger assembly altogether.

Other objects and advantages of the invention will become apparent from the following description taken in connection with the accompanying drawings, wherein is set forth by way of illustration and example, an embodiment of this invention.

DESCRIPTION OF THE PREFERRED EMBODIMENT

An actuation device 10 constructed in accordance with a preferred embodiment of the present invention is shown in FIGS. 1 through 4. The actuation device 10 includes a housing 30 formed by opposed panels 32, 36 defining a chamber therebetween. The panels 32, 36 present similar but opposite configurations with respect to each other. The panels 32, 36 are preferably constructed from a rigid plastic material, although a metal or any other suitable material may also be used.

Figure 1:
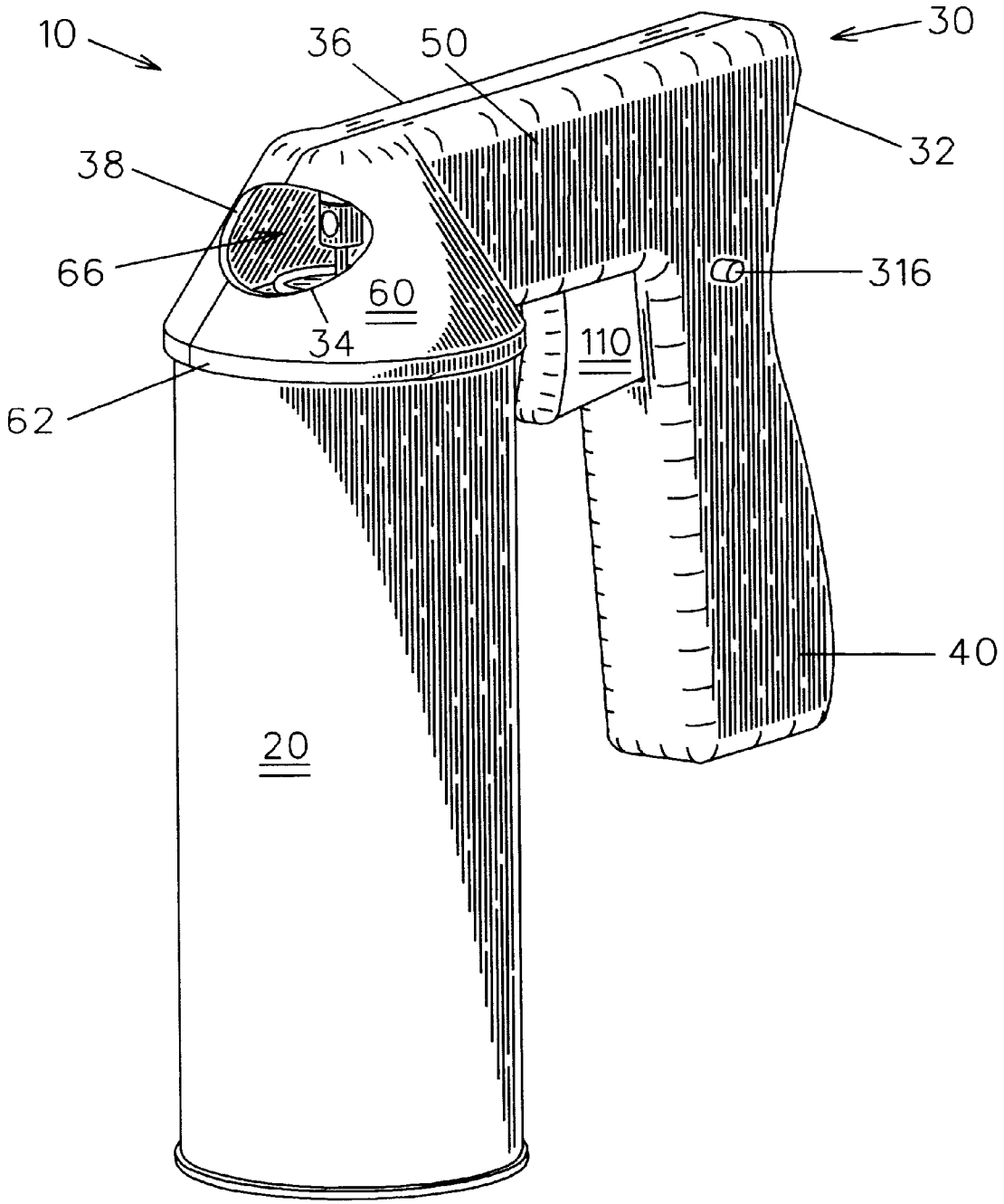
FIG. 1 is a perspective view of an actuation device constructed in accordance with a preferred embodiment of the present invention coupled with a conventional spray can.
Figure 2:
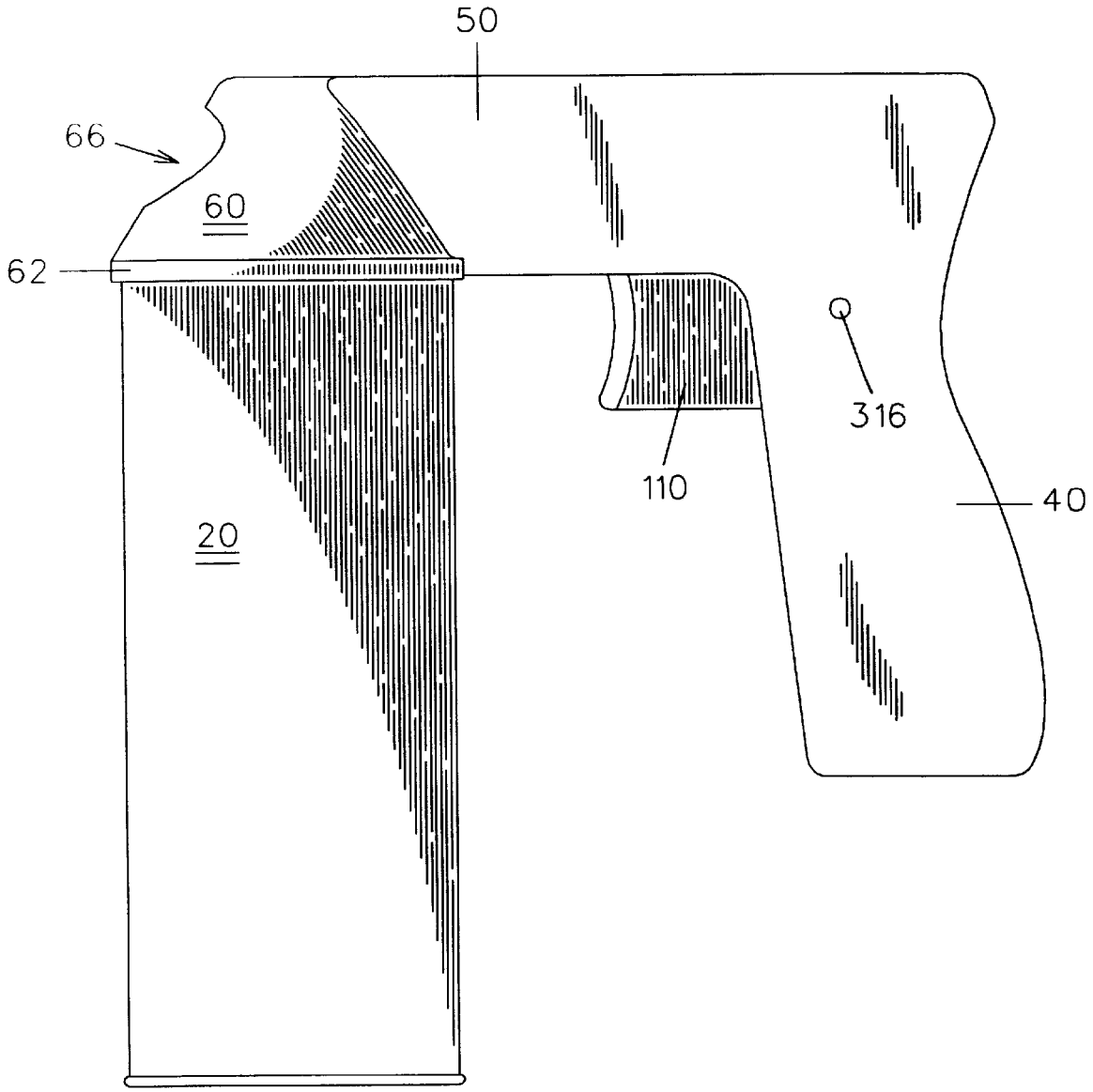
FIG. 2 is a right side view of the device shown in FIG. 1.
Figure 3:
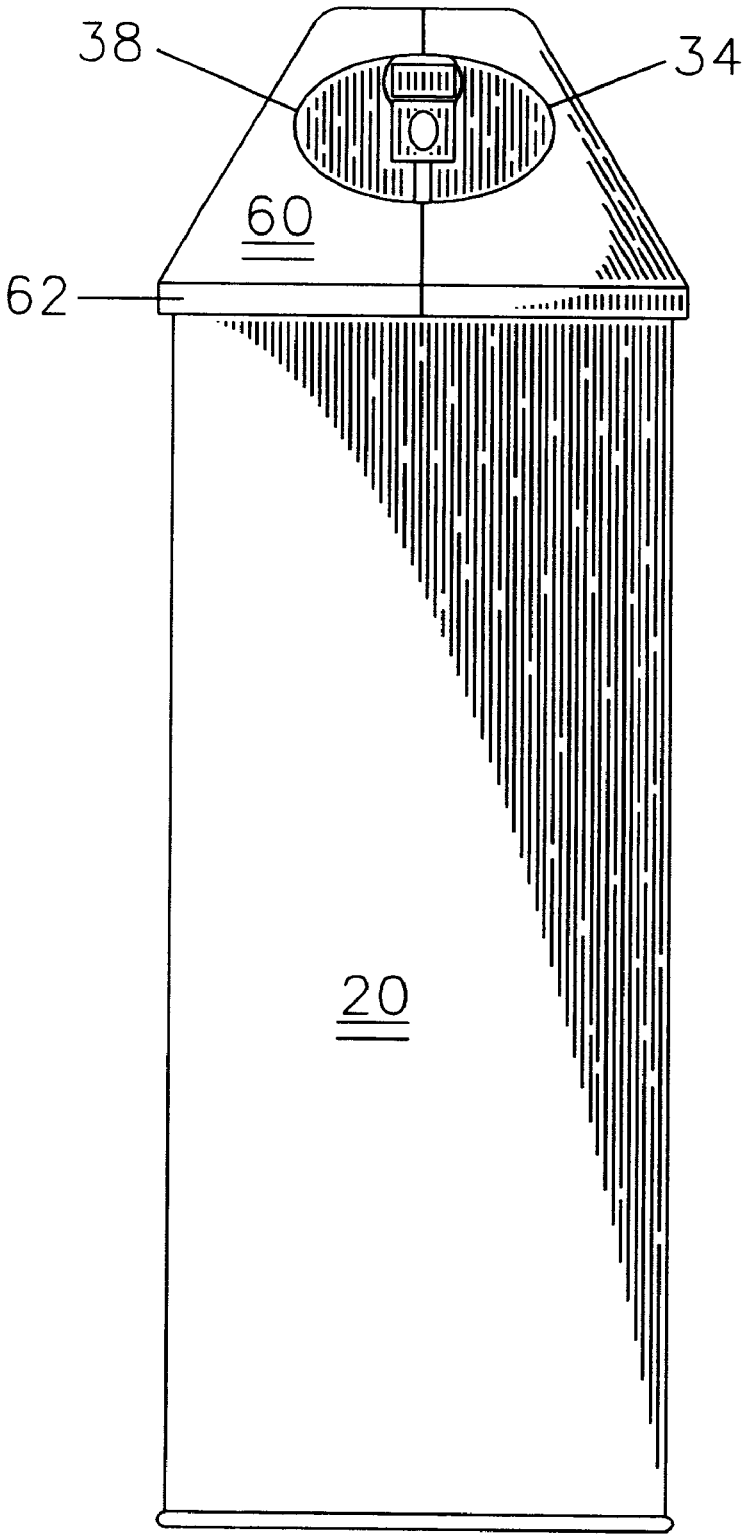
FIG. 3 is a front view of the device shown in FIG. 1.
Figure 4:
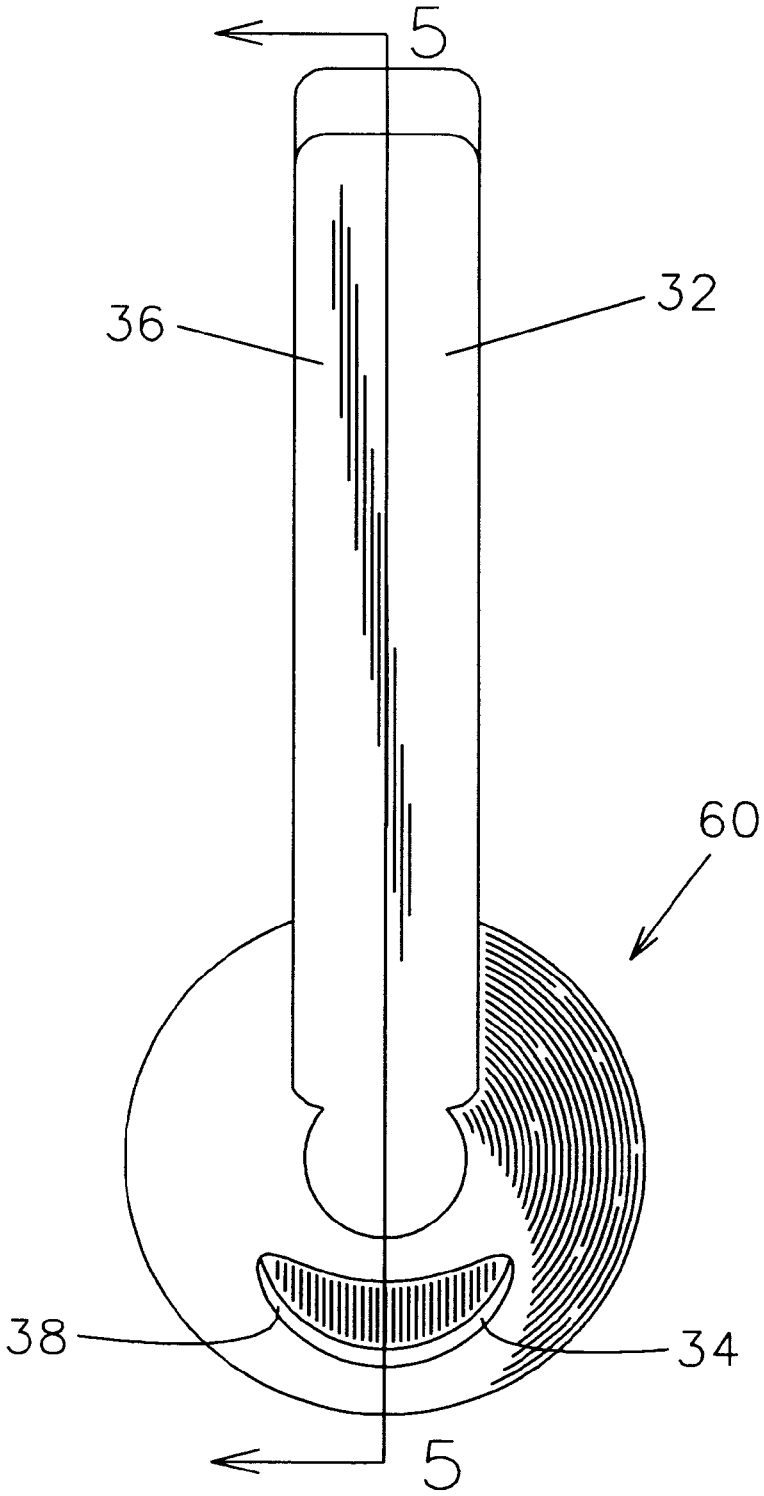
FIG. 4 is a top view of the device shown in FIG. 1.
Figure 5:
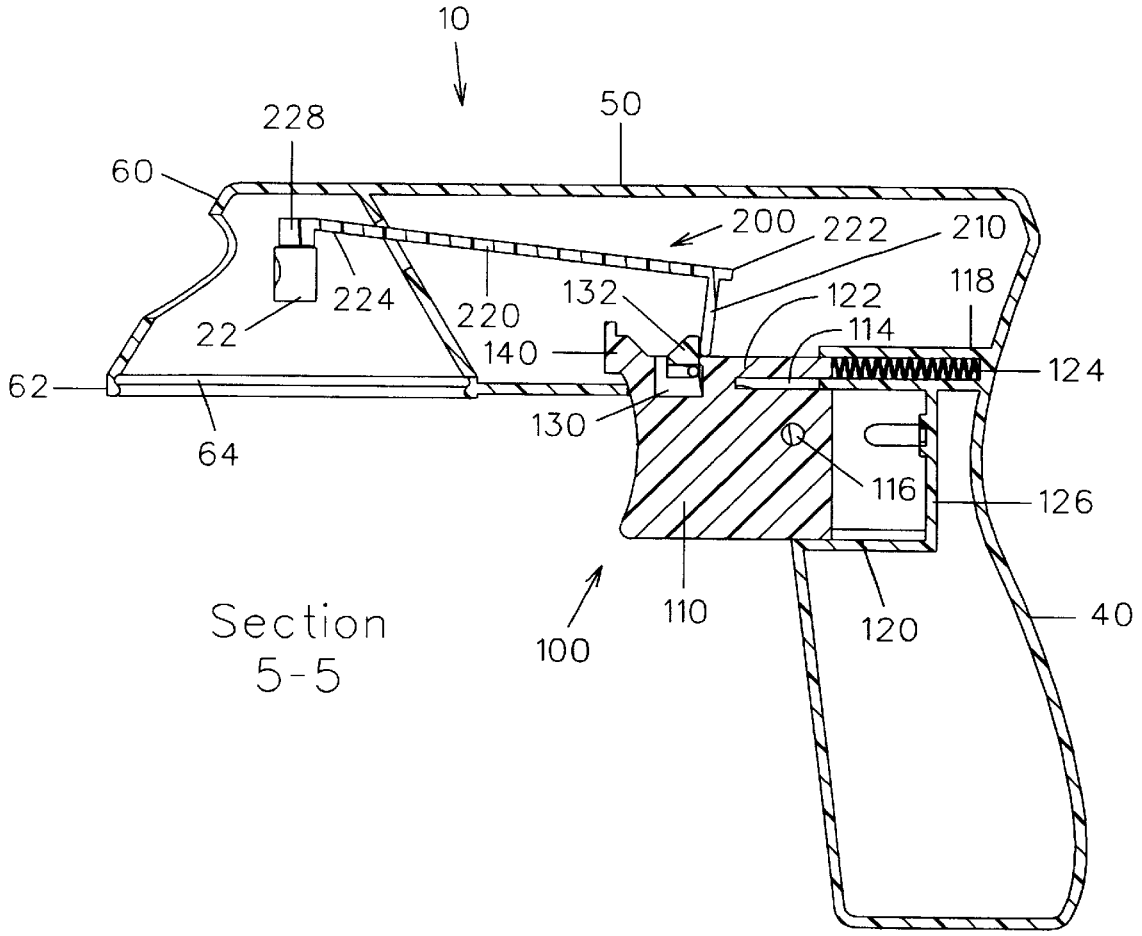
FIG. 5 is a sectional view of the device taken along line 5—5 of FIG. 4 with the trigger assembly in a fully released configuration.
Figure 8:
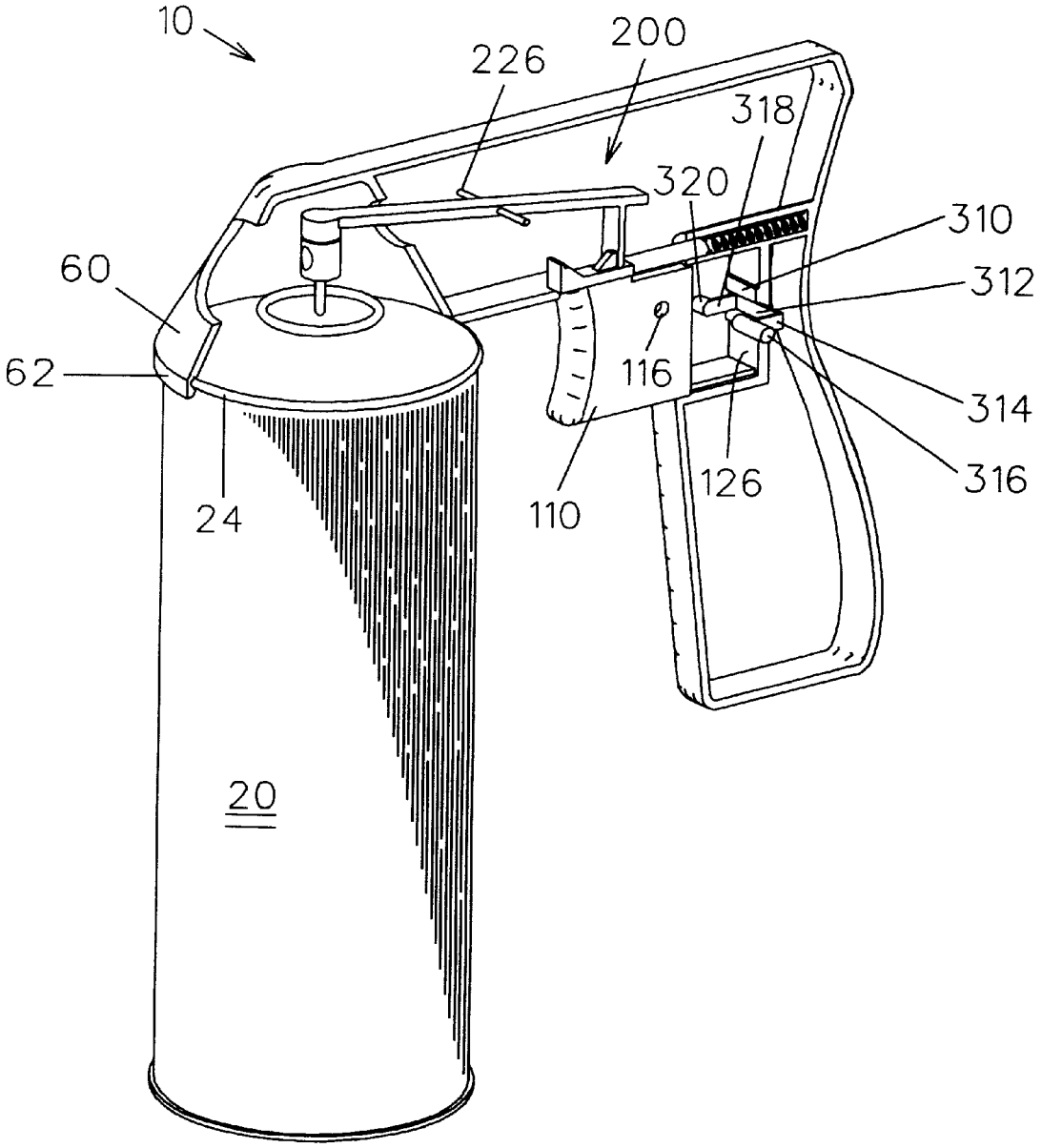
FIG. 8 is a perspective view of the device shown in FIG. 1 with a side panel of the housing removed.

The housing 30 includes a pistol-grip type handle portion 40 integrally attached to an elongated body portion 50 forwardly extending therefrom. The forward end of the body portion 50 presents a conical shroud 60. The shroud 60 includes an annular rim 62 presenting an open, lower end. The diameter of the lower end is relatively greater than the diameter of the top end of the shroud 60. As shown in FIG. 5, the rim 62 further defines a groove 64 which extends interiorly about the rim 62 for snappably engaging the curled or hemmed edge of the rim 24 of an aerosol spray canister 20 (FIG. 8). The edges 34, 38 of the panels 32, 36 define an aperture 66 in the shroud 60 which allows a stream of spray to be expelled from the housing 30 via a canister spray nozzle 22 while protecting the user from misdirected spray.

As shown in FIGS. 5 through 8, the actuation device 10 includes a trigger assembly 100 having a trigger 110 slidably coupled between an upper cylinder 118 and a lower guide rail 120 within the handle portion 40 of the housing 30. A rearwardly extending shaft 122 is attached to the top edge 112 of the trigger with a slot 114 being defined therebetween. Upon depression of the trigger 110 by a user, the shaft 122 bears against a compression spring 124 that is held within the cylinder 118.

Figure 6:
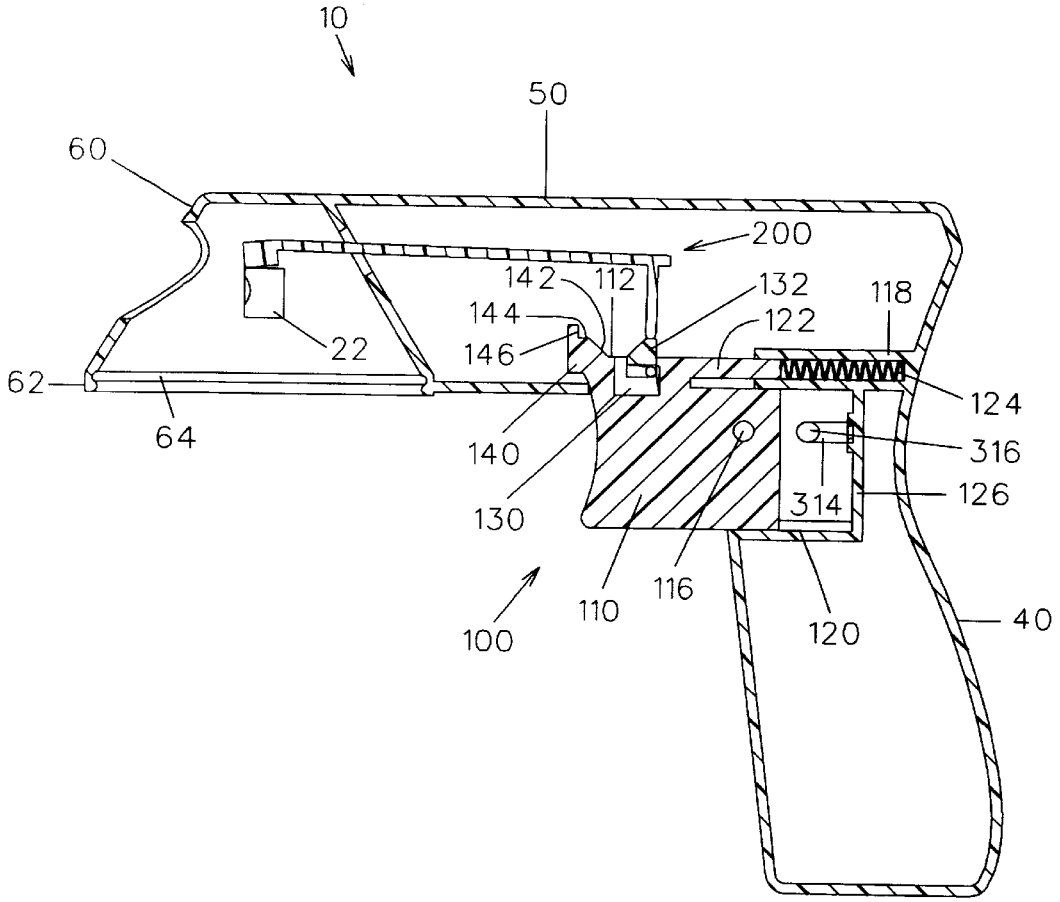
FIG. 6 is a view of the device shown in FIG. 5 with the trigger assembly in a partially released configuration.
Figure 7:
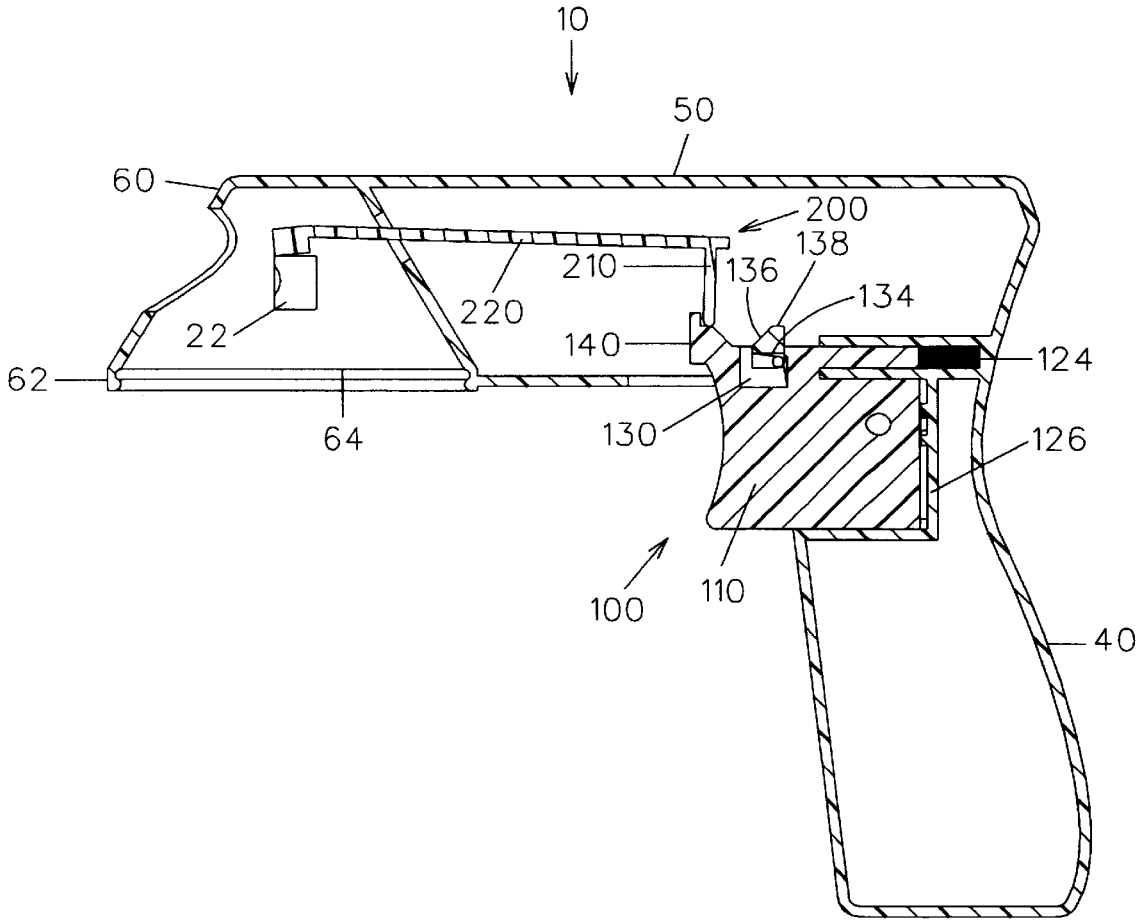
FIG. 7 is a view of the device shown in FIG. 5 with the trigger assembly in a fully depressed configuration.

The top edge 112 of the trigger 110 defines a recess 130 therein. A flange 132 is pivotally mounted to the rear wall of the recess 130 and extends upwardly above the top edge 112 of the trigger 110. The flange 132 is biased toward an upward position by a spring 134 (FIG. 7). The flange 132 includes a rearwardly inclined side 136 extending from a point within the plane of the top edge 112 to a flat upper surface 138 as shown in FIGS. 5–7 for slidably receiving a first engagement arm 210 thereon as further described below. It is understood that the recess 130 is of sufficient dimension to completely receive the flange 132 therein when forward pressure is exerted upon the flange 132. Once the pressure is relieved, the flange 132 returns to the upward position.

An upstanding ramp/flange 140 is fixedly attached to the top edge 112 of the trigger 110 at a point forwardly adjacent the recess 130. The flange 140 comprises a forwardly inclined surface 142 which extends between the top edge 112 of the trigger 110 and a flat upper surface 144. The flange 140 further includes an upstanding brake arm 146 for precluding further sliding of the first engagement arm 210 as described below.

As shown in FIGS. 5–8, the actuation device 10 further includes an engagement member 200 having a first engagement arm 210 bearing against the trigger assembly 100 and normal to one end 222 of a second engagement arm 220. The second arm 220 is pivotally attached to a shaft 226 that is fixedly attached to the panels 32, 36 within the body portion 50 of the housing 30. An opposed end 224 of the second arm 220 is coupled to a tip 228 that is configured to bear against the nozzle 22 of an aerosol spray canister 20.

Figure 9:
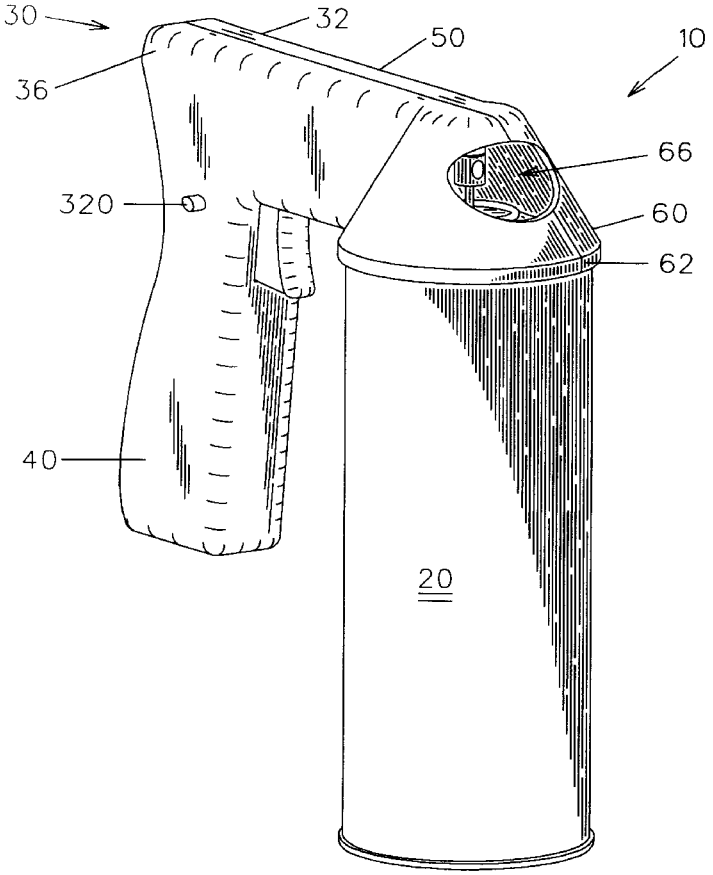
FIG. 9 is a perspective view of the opposite side of the device shown in FIG. 1.

A pair of guide bars 310 are fixedly attached to the rear wall 126 of the trigger assembly 100 with a locking assembly 300 slidably coupled therebetween (FIG. 8). The locking assembly 300 comprises a base member 312 normal to a pair of oppositely disposed forwardly extending legs 314, 318. A flange 316 is fixedly attached to the end of one leg 314 and extends both inwardly and outwardly therefrom. An outwardly extending flange 320 (FIG. 9) is fixedly attached to the opposed leg 318 of the assembly 300. The trigger 110 defines a bore 116 which may register with the flange 316 upon user manipulation of the trigger and locking assemblies 100, 300 as described below.

In operation, an aerosol spray canister 20 is held by the actuation device 10 by inserting the canister through the open end of the shroud 60 until the rim 24 of the canister 20 and the groove 64 within the shroud 60 are held in snappable engagement. Operation of the device 10 can be entirely prevented by inwardly sliding the locking assembly 300 such that the flange 316 blocks depression of the trigger 110. Pressing the opposing flange 320 inwardly releases this locking configuration. A predetermined quantity or a continuous stream of spray may then be actuated through appropriate user manipulations of the trigger assembly 100.

Upon user depression of the trigger 110, the trigger assembly 100 slides rearwardly between the cylinder 118 and lower guide rail 120 with the spring 124 being compressed by the shaft 122. The rearward movement further causes the pivotal flange 132 to be pushed into the recess 130 as the first arm 210 of the engagement member 200 bears against the flange 132. When the trigger assembly 100 has been sufficiently depressed, the pivotal flange 132 is spring biased to return to its upstanding configuration. If the trigger 110 is then released, the compression spring 124 will automatically return the trigger assembly 100 toward its fully released configuration. Accordingly, the first arm 210 is slidably moved up the inclined side 136 of the flange 132 as shown in FIG. 6 and the second arm 220 is pivoted about the shaft 226 such that the tip 228 engages the spray nozzle 22 to dispense the pressurized contents of the spray canister 20. Actuation of the spray nozzle 22 is terminated upon the trigger assembly 100 reaching its FIG. 5 configuration. It is understood that the short burst of spray occurs quickly and automatically as the spring 134 returns the trigger assembly 100 to the fully released configuration so as to provide consistent dispensing of spray.

Alternatively, the trigger 110 may be completely depressed such that the first arm 210 bears against the fixed flange 140, causing the first arm to slidably move up the inclined surface 142 to the flat upper surface 144 (FIG. 7). Upward movement of the first arm 210 causes the second arm 220 to pivot about the shaft 226 such that the tip 228 engages the spray nozzle 22 to dispense the contents of the canister 20. A continuous stream of spray can be maintained by a user holding the trigger assembly 100 in the FIG. 7 configuration or by pressing the lock flange 316 into registration with the bore 116 through the trigger 110. Pressing the opposing flange 320 slidably releases the locking registration so as to allow the trigger assembly 100 to return to its fully released configuration as previously described.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An actuation device for coupling with an aerosol spray canister having a spray nozzle and dispensing a predetermined quantity of the contents of the canister, the device comprising:

a housing defining an interior space and having a shaft positioned within the interior space, the housing having a rear wall;

a trigger assembly including a trigger coupled to the housing and movable between a released position and a depressed position, the trigger presenting a top edge and a rear edge;

a spring positioned between the rear wall of the housing and the rear edge of the trigger whereby the spring is compressed upon movement of the trigger to the depressed position;

a recess defined by the top edge of the trigger; and a flange pivotally mounted within the recess and spring biased to pivot between a flange first position extending above the top edge of the trigger and a flange second position within the recess and flush with the top edge of the trigger; and an engagement member having first and second ends mounted on the shaft for pivotable movement between first and second positions, the first end bearing against the trigger so that the engagement member pivots between the first and second positions as the trigger is moved between the released and depressed positions, respectively, and the second end configured for bearing against the spray nozzle of the canister when the device is coupled with the canister so that as the engagement member is pivoted toward the second position by moving the trigger toward the depressed position the second end of the engagement member depresses the nozzle to dispense the predetermined quantity of the contents of the canister.

2. The actuation device as in claim 1 wherein the engagement member comprises:

a first engagement arm bearing against the pivotal flange; and a second engagement arm having a first end attached to the first engagement arm and a second opposed end configured for bearing against the spray nozzle when the device is coupled with the canister.

3. The actuation device as in claim 1 wherein the trigger assembly further includes:

a bore defined through the trigger;

a lock assembly slidably mounted to the rear wall of the trigger and including oppositely disposed first and second flanges adapted to selectably register with the bore for holding the trigger in a desired position.

4. The actuation device as in claim 3 wherein the locking assembly is positionable so as to bear against a rear edge of the trigger for preventing operation of the trigger assembly.

5. An actuation device for coupling with an aerosol spray canister baying a spray nozzle and dispensing a predetermined quantity of the contents of the canister, the device comprising:

a housing defining an interior space and having a shaft positioned within the interior space the housing including:

a handle portion;

a body portion attached to the handle portion; and a shroud attached to the body portion presenting an annular rim having a groove formed thereabout adapted to snappably engage a curled rim of the aerosol canister, the shroud defining an aperture through a side thereof;

a trigger assembly including a trigger coupled to the housing and movable between a released position and a depressed position; and an engagement member having first and second ends mounted on the shaft for pivotable movement between first and second positions, the first end bearing against the trigger so that the engagement member pivots between the first and second positions as the trigger is moved between the released and depressed positions, respectively, and the second end configured for bearing against the spray nozzle of the canister when the device is coupled with the canister so that as the engagement member is pivoted toward the second position by moving the trigger toward the depressed position the second end of the engagement member depresses the nozzle to dispense the predetermined quantity of the contents of the canister.

6. The actuation device as in claim 5 wherein the trigger presents a top edge and a rear edge, and the housing presents a rear wall, the trigger assembly further including:

a spring positioned between the rear wall of the housing and the rear edge of the trigger whereby the spring is compressed upon movement of the trigger to the depressed position.

7. The actuation device as in claim 6 wherein the trigger assembly further includes:

a bore defined through the trigger;

a lock assembly slidably mounted to the rear wall of the housing including oppositely disposed first and second flanges adapted to selectably register with the bore for holding the trigger in a desired position.

8. The actuation device as in claim 7 wherein the locking assembly is positionable to bear against a rear edge of the trigger for preventing operation of the trigger assembly.

9. An actuation device for coupling with an aerosol spray canister having a spray nozzle and dispensing a predetermined quantity of the contents of the canister, the device comprising:

a housing defining an interior space and having a shaft positioned within the interior space;

a trigger assembly including a trigger coupled to the housing and movable from a released position through a partially depressed position and to a depressed position, the trigger presenting top and rear edges, and defining a bore;

a locking assembly slidably mounted to a rear wall of the housing including oppositely disposed first and second flanges adapted to selectively register with the bore when the trigger is in either of the released or depressed positions for holding the trigger in a desired position; and an engagement member having first and second ends mounted on the shaft for pivotal movement between first and second positions, the first end bearing against the trigger so that the engagement member pivots between the first and second positions as the trigger is moved between the partially depressed and released positions, respectively, and the second end configured for bearing against the spray nozzle of the canister when the device is coupled with the canister so that as the engagement member is pivoted toward the second position by moving the trigger toward the released position the second end of the engagement member depresses the nozzle to dispense the predetermined quantity of the contents of the canister.

10. The actuation device as in claim 9 wherein the trigger assembly further includes a spring positioned between the rear wall of the housing and the rear edge of the trigger so that the spring is compressed upon movement of the trigger assembly to the depressed position.

11. The actuation device as in claim 9 wherein the trigger top edge defines:

a recess; and a flange is pivotally mounted within the recess and spring biased to pivot between a flange first position extending above the top edge of the trigger and a flange second position within the recess and flush with the top edge of the trigger.

12. The actuation device as in claim 11 wherein the engagement member comprises:

a first engagement arm bearing against the pivotal flange; and a second engagement arm having a first end attached to the first engagement arm and a second opposed end configured for bearing against the spray nozzle when the device is coupled with the canister.

13. The actuation device of claim 9 wherein the housing further includes:

a handle portion;

a body portion attached to the handle portion; and a shroud attached to the body portion presenting an annular rim having a groove formed thereabout adapted to snappably engage a curled rim of the aerosol canister, the shroud defining an aperture through a side thereof.

* * * * *